US008620187B2

(12) United States Patent
Gilmartin et al.

(10) Patent No.: US 8,620,187 B2
(45) Date of Patent: Dec. 31, 2013

(54) SURFACE COATINGS FOR THE BIAS CHARGING ROLLER

(75) Inventors: Brian P. Gilmartin, Williamsville, NY (US); Jin Wu, Pittsford, NY (US); April M. Mattox, Webster, NY (US); Aaron M. Stuckey, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 152 days.

(21) Appl. No.: 13/171,361

(22) Filed: Jun. 28, 2011

(65) Prior Publication Data

US 2013/0004205 A1 Jan. 3, 2013

(51) Int. Cl.
*G03G 15/02* (2006.01)

(52) U.S. Cl.
USPC ..... 399/176; 399/168

(58) Field of Classification Search
USPC ..... 399/115, 174, 176, 285
See application file for complete search history.

(56) References Cited

U.S. PATENT DOCUMENTS

| | | | | | |
|---|---|---|---|---|---|
| 4,967,231 | A | * | 10/1990 | Hosoya et al. | 399/176 |
| 5,497,219 | A | * | 3/1996 | Kurokawa et al. | 399/176 |
| 5,576,810 | A | * | 11/1996 | Aita et al. | 399/177 |
| 5,860,046 | A | * | 1/1999 | Ikegawa et al. | 399/174 |
| 6,020,054 | A | * | 2/2000 | Masuda et al. | 428/319.3 |
| 6,052,549 | A | * | 4/2000 | Shimura et al. | 399/176 |
| 6,096,395 | A | * | 8/2000 | Hayashi et al. | 428/35.9 |
| 6,173,143 | B1 | * | 1/2001 | Hirota et al. | 399/176 |
| 6,317,574 | B1 | * | 11/2001 | Shinohara et al. | 399/176 |

* cited by examiner

*Primary Examiner* — Clayton E Laballe
*Assistant Examiner* — Jas Sanghera
(74) *Attorney, Agent, or Firm* — MH2 Technology Law Group LLP

(57) ABSTRACT

Various embodiments provide materials and methods for bias charging members including an outer surface coating overlaying an outer base layer, wherein the outer surface coating can include conductive fillers combined with one or more polymers to provide desirable surface, electrical, and/or mechanical properties.

11 Claims, 3 Drawing Sheets

SURFACE COATINGS FOR THE BIAS CHARGING ROLLER

DETAILED DESCRIPTION

Background

In a typical electrostatographic reproducing apparatus, a light image of an original to be copied is recorded in the form of an electrostatic latent image upon a photosensitive member. The latent image is subsequently rendered visible by the application of electroscopic thermoplastic resin particles which are commonly referred to as toner. Specifically, the photosensitive member is charged and then exposed to light from an optical system or an image input apparatus to form the electrostatic latent image thereon. After the toner particles have been deposited on the surface of the photoconductive member, they are transferred to a copy sheet or to an intermediate transfer member and subsequently transferred to a copy sheet. Permanent images are then formed on the copy sheet by a fusing process.

Bias charging rollers (BCRs) are often used as chargers for corona charging the photosensitive member because they emit less ozone and are more environmentally friendly, as compared with scorotron chargers. However, BCR charging requires direct contact with the photosensitive member and with other related printer members. Due to this direct contact, stress is added on the surface of the BCRs as well as on the related printer members that come in direct contact with the BCRs. Surface deformations are then formed including streaks, abrasions, and pothole-like deformations that consequently produce print defects. For example, dark streaks and white/dark spots can appear as a result of degradation and/or debris built up on the surface of BCRs. Usage life of BCRs and the related printer members is then reduced.

There is a need to provide materials and methods for bias charging members with desirable surface, electrical, and/or mechanical properties to extend their usage life.

SUMMARY

According to various embodiments, the present teachings include a bias charging member. The bias charging member can include a conductive substrate; an outer base layer having a surface roughness $R_z$ ranging from about 0.1 μm to about 4 μm disposed over the conductive substrate; and an outer surface coating disposed on the outer base layer, the outer surface coating including a plurality of conductive fillers combined with one or more polymers to provide the outer surface coating with a surface roughness $R_z$ of less than about 2 μm.

According to various embodiments, the present teachings also include a bias charging member. The bias charging member can include a conductive substrate and an outer base layer disposed over the conductive substrate. The outer base layer can be formed of a material selected from the group consisting of isoprenes, chloroprenes, epichlorohydrins, butyl elastomers, polyurethanes, silicone elastomers, fluorine elastomers, styrene-butadiene elastomers, butadiene elastomers, nitrile elastomers, ethylene propylene elastomers, epichlorohydrin-ethylene oxide copolymers, epichlorohydrin-ethylene oxide-allyl glycidyl ether copolymers, ethylene-propylene-diene (EPDM) elastomers, acrylonitrile-butadiene rubbers (NBR), natural rubber, and combinations thereof. The outer base layer can have a surface roughness $R_z$ ranging from about 0.1 μm to about 4 μm. The bias charging member can also include an outer surface coating disposed on the outer base layer. The outer surface coating can include one or more polymers and a plurality of conductive fillers to provide the outer surface coating with a surface roughness $R_z$ of less than about 2 μm. The one or more polymers can selected from the group consisting of polycaprolactone, polyurethane, polyurea, polyolefin, polyester, polyimide, polyamide, polycarbonate, phenolic resin, aminoplast resin, copolymer derived from conjugated diene monomers, vinyl aromatic monomer, ethylenically unsaturated nitrile monomer, fluoropolymer, and combinations thereof.

According to various embodiments, the present teachings further include a bias charging member. The bias charging member can include a conductive substrate; an outer base layer provided over the conductive substrate; and an outer surface coating disposed on the outer base layer, the outer surface coating including a plurality of conductive fillers and one or more polymers. The outer base layer can be formed of a material selected from the group consisting of isoprenes, chloroprenes, epichlorohydrins, butyl elastomers, polyurethanes, silicone elastomers, fluorine elastomers, styrene-butadiene elastomers, butadiene elastomers, nitrile elastomers, ethylene propylene elastomers, epichlorohydrin-ethylene oxide copolymers, epichlorohydrin-ethylene oxide-allyl glycidyl ether copolymers, ethylene-propylene-diene (EPDM) elastomers, acrylonitrile-butadiene rubbers (NBR), natural rubber, and combinations thereof. The outer base layer can have a surface resistivity ranging from about $10^5$ ohm/square to about $10^{13}$ ohm/square and a surface roughness $R_z$ ranging from about 0.1 μm to about 4 μm. The one or more polymers of the outer surface layer can include a material selected from melamine resins, phenolic resins, copolymers derived from conjugated diene monomers, vinyl aromatic monomers, and ethylenically unsaturated nitrile monomers, and combinations thereof. The outer surface coating can have a surface resistivity ranging from about $10^5$ ohm/square to about $10^{10}$ ohm/square and a surface roughness $R_z$ ranging from about 0.1 μm to about 1.99 μm.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Figure 1A:
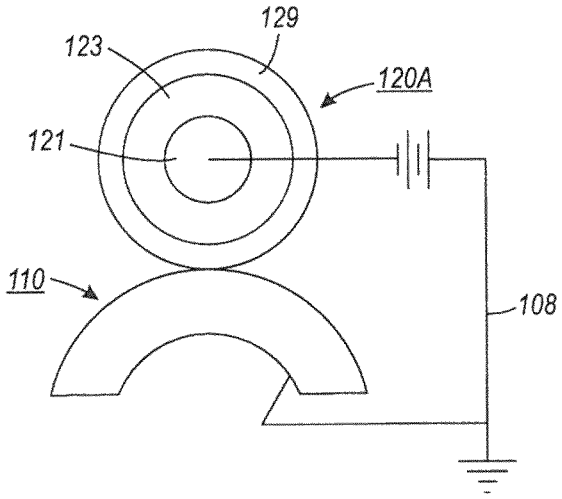
FIGS. 1A-1B depict various exemplary bias charging devices in accordance with various embodiments of the present teachings.
Figure 1B:
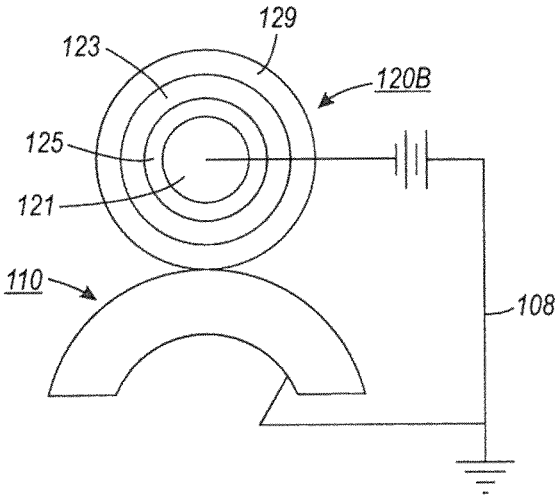

FIGS. 1A-1B depict exemplary bias charging devices in accordance with various embodiments of the present teachings. For example, each device in FIGS. 1A-1B can include a photosensitive member, such as a photoconductive drum 110, which can be charged on its surface by a charger to which a voltage can be supplied by a power source 108. The charger can be, for example, a bias charging member in a form of a bias charging roller 120 A-B as depicted in FIGS. 1A-1B, although one of ordinary skill in the art will understand that other types of bias charging members can be used including a bias charging belt, sheet, film, or drelt (a cross between a belt and a drum) in accordance with various embodiments of the present teachings. Accordingly, various conductive substrates in a form of a roller, a belt, and/or a drelt can be used for the bias charging members in the bias charging devices.

Each exemplary bias charging roller 120 A/B can include a layer stack including an outer surface coating 129 disposed over/on an outer base layer 123. The layer stack can be disposed over a conductive substrate such as a conductive core 121. As shown in FIGS. 1A-1B, while the bias charge roller 120 A/B is in rotation, a DC voltage and optional AC current can be applied from the power source 108 to the conductive core 121 of the bias charging roller 120 A/B to cause it to charge the photosensitiv drum 110.

Although each bias charging member 120 A/B in FIGS. 1A-1B is held in contact with the exemplary photoconductive drum 110, one of ordinary skill in the art would understand that the bias charging members 120 A-B can be used for charging a dielectric receiver or other suitable members to be charged. Additionally, instead of using a photoconductive drum, the photoconductive member can be in a form of a belt, a film, a drelt (a cross between a belt and a drum), or other known photoconductive members.

In one embodiment, the bias charging roller 120A in FIG. 1A can include the conductive core 121 and the layer stack (including the outer surface coating 129 over/on the outer base layer 123) directly provided on the conductive core 121 in accordance with various embodiments of the present teachings.

In embodiments, an optional layer, such as intermediate layers and/or adhesive layers, can be positioned between any adjacent layers of FIG. 1A. For example, the exemplary bias charging roller 120B shown in FIG. 1B can include all of the elements of FIG. 1A and further include an optional layer, intermediate layers and/or adhesive layers, positioned between the conductive core 121 and the outer base layer 123 as shown in FIG. 1B, and/or between the outer base layer 123 and the outer surface coating 129.

The conductive core 121 in FIGS. 1A-1B can serve as an electrode and a supporting member of each bias charging roller 120 A/B. The conductive core 121 can be formed of an electro-conductive material including, but not limited to, a metal or metal alloy of aluminum, copper alloy, stainless steel, or the like; iron coated with chromium or nickel plating; and/or an electro-conductive resin and the like. The diameter of the electro-conductive support can be, for example, from about 1 mm to about 20 cm, or from about 3 mm to about 10 cm, or from about 5 mm to about 2 cm. Any suitable conductive cores or substrates as known to one of ordinary skill in the art can be used in accordance with various embodiments of the present teachings.

The outer base layer 123 can be formed of materials including, for example, isoprenes, chloroprenes, epichlorohydrins, butyl elastomers, polyurethanes, silicone elastomers, fluorine elastomers, styrene-butadiene elastomers, butadiene elastomers, nitrile elastomers, ethylene propylene elastomers, epichlorohydrin-ethylene oxide copolymers, epichlorohydrin-ethylene oxide-allyl glycidyl ether copolymers, ethylene-propylene-diene (EPDM) elastomers, acrylonitrile-butadiene copolymers (NBR), natural rubber, and the like, and combinations thereof.

The optional intermediate layers and/or adhesive layers can be applied to achieve desired properties and performance objectives of the disclosed bias charging members. Exemplary intermediate layers can be an elastomer layer, such as an intermediate conductive rubber layer formed of materials including, for example, silicone, EPDM, urethane, epichlorohydrin, etc. Exemplary adhesive layers can be formed of, for example, epoxy resins and polysiloxanes. Adhesives can include proprietary materials such as THIXON 403/404, Union Carbide A-1100, Dow H41, Dow TACTIX 740, Dow TACTIX 741, and Dow TACTIX 742.

In embodiments, instead of using bias charging rollers, various bias charging belts, or sheets, or drelts, e.g., corresponding to the materials, and structures of the rollers 120 A-B, can be used for charging the photosensitive member.

Figure 2A:
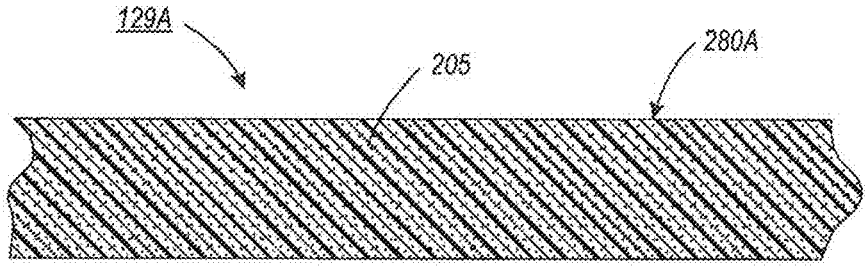
FIGS. 2A-2B depict various exemplary outer surface coatings for a bias charging member in accordance with various embodiments of the present teachings.
Figure 2B:
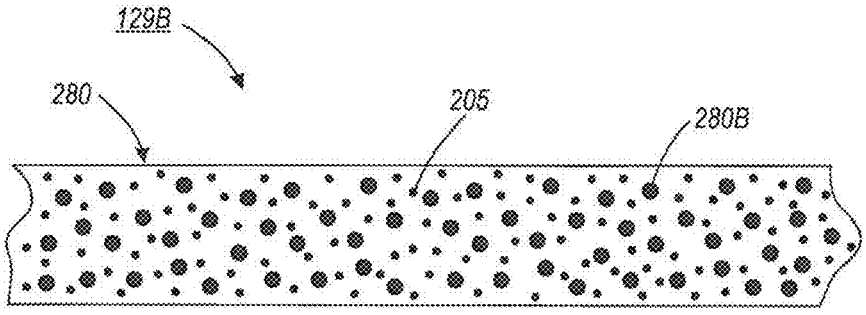

The disclosed outer surface coating 129, 129 A/B, provided over/on the outer base layer 123 for each bias charging member 120 A-B can include at least a plurality of fillers combined with one or more polymers. For example, FIGS. 2A-2B depict various exemplary outer surface coatings 129 A-B in accordance with various embodiments of the present teachings. As shown, the one or more polymers can form a polymer matrix 280A and/or 280 as shown in FIGS. 2A-2B and/or can be polymer particles 280B as shown in FIG. 2B. The polymer particles 280B can have an average particle size ranging from about 20 nm to about 10 μm, or from about 100 nm to about 2 μm, or from about 300 nm to about 1 μm dispersed within the outer surface coating 129B. The polymer particles 280B can be present in an amount ranging from about 50% to about 99%, or from about 60% to about 95%, or from about 70% to about 90%, by weight of the total outer surface coating.

The fillers 205 can be conductive or semiconductive. Exemplary filler materials can include, but are not limited to, carbon black such as Ketjen Black and acetylene black; pyrolytic carbon, graphite; metal or metal alloy such as aluminum, copper, nickel and stainless steel; metal oxides, doped metal oxides, such as tin oxide, indium oxide, titanium oxide, tin oxide-antimony oxide solid solution, and tin oxide-indium oxide solid solution; conductive polymers; insulating materials having a surface treated by an electro-conductive process and the like; perchlorates or chlorates of tetraethylammonium, lauryltrimethyl ammonium and the like; perchlorates or chlorates of alkali metal such as lithium and magnesium, and salts of alkali or alkaline-earth metals; and the like; and/or their combinations. Exemplary conductive polymers can include, but are not limited to, polyaniline, polythiophene, polypyrrole, poly(3,4-ethylenedioxythiophene):poly(styrenesulfonate) polymers (PEDOT:PSS), PEDOT-PEG (i.e., polyethylene glycol) block copolymers, and combinations thereof.

In embodiments, the conductive or semiconductive fillers 205 can be included in each layer of the bias charging members 120 A-B, including the outer surface coating 129, the outer base layer 123, optional intermediate layers, and/or optional adhesive layers.

The outer surface coating 129 can also include one or more polymers. Exemplary polymers can include, but are not limited to, polycaprolactone (PCL), polyurethane, polyurea, polyolefin, polyimide, phenolic resins, aminoplast resins, copolymers derived from conjugated diene monomers, vinyl aromatic monomers, and ethylenically unsaturated nitrile monomers, fluoropolymers and combinations thereof.

Polycaprolactones can be thermoplastic and can have a weight average molecular weight ranging from about 10,000 to about 80,000, such as from about 20,000 to about 50,000, or from about 25,000 to about 45,000. Commercially available examples of thermoplastic polycaprolactones can include Capa® 6250 and Capa® 6100 (Perstorp AB of Perstorp, Sweden, and/or Perstorp USA of Toledo, Ohio).

Copolymers derived from conjugated diene monomers, vinyl aromatic monomers, and/or ethylenically unsaturated nitrile monomers can include styrene-butadiene (SB) copolymers, acrylonitrile-butadiene (NBR) copolymers, acrylonitrile-butadiene-styrene (ABS) terpolymers, and the like, and combinations thereof. In a particular embodiment, the polymers used for the outer surface coating 129, 129 A/B can be a thermoplastic acrylonitrile-butadiene-styrene (ABS) terpolymer. Acrylonitrile can include from about 15 wt % to about 35 wt % of the ABS terpolymer. Butadiene can include from about 5 wt % to about 30 wt % of the ABS terpolymer. Styrene can include from about 40 wt % to about 60 wt % of the ABS terpolymer. A commercially available example of ABS copolymers can include, for example, Blendex® 200 from Chemtura Corp. of Middlebury, Conn.

Various polyurethanes can suitably be used herein as a thermoplastic or thermoset polymer for the outer surface coating 129, 129 A/B. In embodiments, suitable polyurethanes can be derived from polyacrylates and polyisocyanates. Suitable polyurethanes can include, but are not limited to, reaction products of polyaspartic acid ester and isocyanate ("2K urethane"); reaction products of hydroxy-functional polyacrylates and isocyanate; and the like, and combinations thereof. Commercially available examples of polyacrylates can include Desmophen® NH 1120 and Desmophen® A 450 BA (Bayer Material Science AG of Leverkusen, Germany). Commercially available examples of isocyanates can include Desmodur® BL 3175A (Bayer Material Science AG of Leverkusen, Germany).

Various phenolic resins can be used herein as the polymer for the outer surface coating 129, 129 A/B. As used herein, the term "phenolic resins" refers to condensation products of an aldehyde with a phenol source in the presence of an acidic or basic catalyst.

The phenol source can be, for example, phenol, alkyl-substituted phenols such as cresols and xylenols; halogen-substituted phenols such as chlorophenol; polyhydric phenols such as resorcinol or pyrocatechol; polycyclic phenols such as naphthol and bisphenol A; aryl-substituted phenols; cycloalkyl-substituted phenols; aryloxy-substituted phenols; and the like, and combinations thereof. In various embodiments, the phenol source can be phenol, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols such as bisphenol A, and combinations thereof.

The aldehyde for use in making the phenolic resin can be, for example, formaldehyde, paraformaldehyde, acetaldehyde, butyraldehyde, paraldehyde, glyoxal, furfuraldehyde, propinonaldehyde, benzaldehyde, and combinations thereof. In one embodiment, the aldehyde can be formaldehyde.

Non-limiting examples of phenolic resins can include dicyclopentadiene type phenolic resins, phenol novolak resins, cresol novolak resins, phenol aralkyl resins, and combinations thereof. Other non-limiting examples of phenolic resins can include alcohol-soluble resol-type phenolic resins such as PHENOLOTE® J-325 (DIC Corp. of Tokyo, Japan); formaldehyde polymers with phenol, p-tert-butylphenol, and cresol, such as VARCUM™ 29159 and 29101 (OxyChem. Co.) and DURITE® 97 (Borden Chemical); or formaldehyde polymers with ammonia, cresol, and phenol, such as VARCUM® 29112 (OxyChem. Co.); or formaldehyde polymers with 4,4'-(1-methylethylidene)bisphenol such as VARCUM® 29108 and 29116 (OxyChem. Co.); or formaldehyde polymers with cresol and phenol such as VARCUM™ 29457 (OxyChem. Co.), DURITE® SD-423A, SD-422A (Borden Chemical); or formaldehyde polymers with phenol and p-tert-butylphenol such as DURITE® ESD 556C (Border Chemical).

In embodiments, the phenolic resins can be used as-is or they can be modified. For example, the phenolic resins can be modified with suitable plasticizers, e.g. including but not limited to polyvinyl butyral, nylon resins, thermoset acrylic resins, polyvinyl formal, alkyds, epoxy resins, phenoxy resins (bisphenol A, epichlorohydrin polymer, and the like), polyamides, polyacrylates, oils, and the like, and combinations thereof. Various modifiers are known under various trade names, including but not limited to DESMOPHEN®, DESMODUR®, BUTVAR®, ELVAMIDE®, DORESCO®, SILCLEAN®, and PARALOID®.

Various aminoplast resins can be used herein as the polymer for the outer surface coating 129, 129 A/B. As used herein, the term "aminoplast resin" refers to amino resins made from a nitrogen-containing substance and formaldehyde, wherein the nitrogen-containing substance can include melamine, urea, benzoguanamine, and/or glycoluril. The aminoplast resins can be highly alkylated or partially alkylated. In embodiments, the aminoplast resins can be used as-is or they can be modified. For example, the aminoplast resins can be modified with suitable plasticizers, e.g. including but not limited to polyvinyl butyral, nylon resins, thermoset acrylic resins, polyvinyl formal, alkyds, epoxy resins, phenoxy resins (bisphenol A, epichlorohydrin polymer, and the like), polyamides, polyacrylates, oils, and the like, and combinations thereof. Various modifiers are known under various trade names, including but not limited to DESMOPHEN®, DESMODUR®, BUTVAR®, ELVAMIDE®, DORESCO®, SILCLEAN®, and PARALOID®.

If melamine is used, the resulting aminoplast resin can be known as a "melamine resin". Melamine resins are known under various trade names, including but not limited to CYMEL®, BEETLE®, DYNOMIN®, BECKAMINE®, UFR®, BAKELITE®, ISOMIN®, MELAICAR®, MELBRITE®, MELMEX®, MELOPAS®, RESART®, and ULTRAPAS®.

The melamine resin can have a generic formula of:

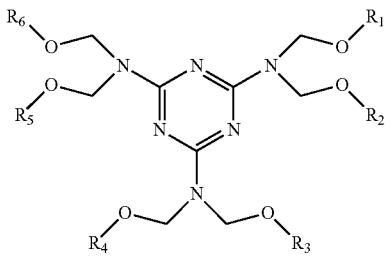

in which $R_1$, $R_2$, $R_3$, $R_4$, $R_5$ and $R_6$ can be the same or different and each independently represents a hydrogen atom or an alkyl chain with from about 1 to about 12 carbon atoms, or with from about 1 to about 8 carbon atoms, or with from about 1 to about 4 carbon atoms.

The melamine resin can be water-soluble, dispersible or indispersible. In various embodiments, the melamine resin can be highly alkylated/alkoxylated, partially alkylated/alkoxylated, or mixed alkylated/alkoxylated. In various embodiments, the melamine resin can be methylated, n-butylated or isobutylated. In other embodiments, the melamine resin can have low methylol and high imino content. In embodiments, the melamine resin can be described as oligomeric in nature with methoxymethyl and imino main functionalities. Non-limiting examples of the melamine resin can include methylated high imino melamine resins (partially methylolated and highly alkylated) such as CYMEL® 323, 325, 327, 328, 385; highly methylated melamine resins such as CYMEL® 350, 9370; partially methylated melamine resins (highly methylolated and partially methylated) such as CYMEL® 373, 370; high solids mixed ether melamine resins such as CYMEL® 1130, 324; n-butylated melamine resins such as CYMEL™ 1151, 615; n-butylated high imino melamine resins such as CYMEL® 1158; iso-butylated melamine resins such as CYMEL® 255-10. CYMEL® melamine resins are commercially available from Cytec Industries Inc. of Woodland Park, N.J.

In embodiments, the melamine resin can be selected from methylated formaldehyde-melamine resin, methoxymethylated melamine resin, ethoxymethylated melamine resin, propoxymethylated melamine resin, butoxymethylated melamine resin, hexamethylol melamine resin, alkoxyalkylated melamine resins such as methoxymethylated melamine resin, ethoxymethylated melamine resin, propoxymethylated melamine resin, butoxymethylated melamine resin, and mixtures thereof.

In embodiments, if urea is used, the resulting aminoplast resin is also known as a "urea resin". Urea resins are known under various trade names, including but not limited to CYMEL® BEETLE® DYNOMIN® BECKAMINE® and AMIREME®.

The urea resin can have a generic formula of:

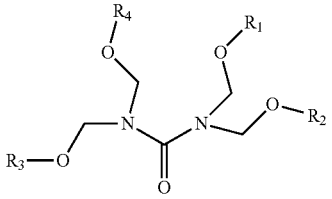

in which $R_1$, $R_2$, $R_3$, and $R_4$ can be the same or different and each independently represents a hydrogen atom or an alkyl chain with from about 1 to about 12 carbon atoms, or with from about 1 to about 8 carbon atoms, or with from about 1 to about 4 carbon atoms.

In embodiments, the urea resin can be water-soluble, dispersible or indispersible. In various embodiments, the urea resin can be highly alkylated/alkoxylated, partially alkylated/alkoxylated, or mixed alkylated/alkoxylated. In various embodiments, the urea resin can be methylated, n-butylated or isobutylated. Non-limiting examples of the urea resin can include methylated urea resins such as CYMEL® U-65, U-382; n-butylated urea resins such as CYMEL® U-1054, UB-30-B; iso-butylated urea resins such as CYMEL® U-662, UI-19-I. CYMEL® urea resins are commercially available from Cytec Industries Inc. of Woodland Park, N.J.

In embodiments, if benzoguanamine is used, the resulting aminoplast resin is also known as a "benzoguanamine resin". Benzoguanamine resins are known under various trade names, including but not limited to CYMEL®, BEETLE®, and UFORMITE®.

The benzoguanamine resin can have a generic formula of:

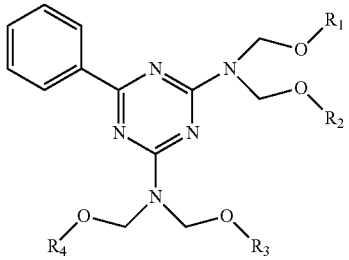

in which $R_1$, $R_2$, $R_3$, and Rican be the same or different and each independently represents a hydrogen atom or an alkyl chain with from about 1 to about 12 carbon atoms, or with from about 1 to about 8 carbon atoms, or with from about 1 to about 4 carbon atoms.

The benzoguanamine resin can be water-soluble, dispersible or indispersible. In various embodiments, the benzoguanamine resin can be highly alkylated/alkoxylated, partially alkylated/alkoxylated, or mixed alkylated/alkoxylated. In various embodiments, the benzoguanamine resin can be methylated, n-butylated or isobutylated. Non-limiting examples of the benzoguanamine resin can include CYMEL® 659, 5010, 5011. CYMEL® benzoguanamine resins are commercially available from Cytec Industries Inc. of Woodland Park, N.J.

In embodiments, if glycouracil is used, the resulting aminoplast resin is also known as a "glycoluril resin". Glycoluril resins are known under various trade names, including but not limited to CYMEL®, and POWDERLINK®.

The glycoluril resin can have a generic formula of:

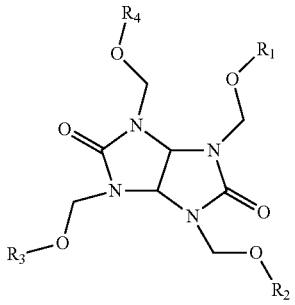

in which $R_1$, $R_2$, $R_3$, and $R_4$ can be the same or different and each independently represents a hydrogen atom or an alkyl chain with from about 1 to about 12 carbon atoms, or with from about 1 to about 8 carbon atoms, or with from about 1 to about 4 carbon atoms.

The glycoluril resin can be water-soluble, dispersible or indispersible. In various embodiments, the glycoluril resin can be highly alkylated/alkoxylated, partially alkylated/alkoxylated, or mixed alkylated/alkoxylated. In various embodiments, the glycoluril resin can be methylated, n-butylated or isobutylated. Non-limiting examples of the glycoluril resin include CYMEL® 1170, 1171. CYMEL® glycoluril resins are commercially available from Cytec Industries Inc. of Woodland Park, N.J.

In embodiments, fluorine-containing polymers or fluoropolymers can be used for the outer surface coating 129, 129 A/B, for example, as fluoropolymer particles. These fluoropolymers can include, e.g., a monomeric repeat unit that is selected from the group consisting of vinylidene fluoride, hexafluoropropylene, tetrafluoroethylene, perfluoroalkylvinylether, and mixtures thereof. The fluoropolymers can include linear or branched polymers, and cross-linked fluoroelastomers. Examples of fluoropolymer can include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP), and mixtures thereof. In embodiments, fluoropolymers and/or their particles can provide chemical and thermal stability and have a low surface energy. The fluoropolymers and/or their particles can have a melting temperature of from about 255° C. to about 360° C. or from about 280° C. to about 330° C. In a certain embodiment, the exemplary fluoropolymers and/or their particles can be melted to form the outer surface coating.

The outer surface coating 129, 129 A/B can be formed by various film-forming techniques including a coating process, followed by a solidifying process such as a curing, drying, melting, and/or cooling process to physically or chemically crosslink the polymers to form a polymer matrix.

For example, a dispersion including conductive fillers and one or more polymers (e.g., PCL) can be prepared by, e.g., ball milling them in a solvent such as a toluene. This process can take several days. The dispersion can include a solid percentage by weight ranging from about 5% to about 60%, or from about 10% to about 50%, or from about 20% to about 40%. The dispersion can then be coated to, for example, a conductive substrate of a BCR, an intermediate layer of a BCR, an adhesive layer of a BCR, and/or a conventional outer base layer of a conventional BCR. Exemplary coating techniques for applying the dispersion onto a surface can include, but are not limited to, dip coating, roller coating, spray coating, rotary atomizers, ring coating, die casting, flow coating, and the like. The applied or coated dispersion can then be solidified, e.g., cured or dried, according to the polymers used.

Alternatively, the dispersion can be prepared to include conductive fillers and a plurality of polymer particles. In embodiments, the polymer particles can be contained in a polymer particle dispersion, which is then mixed with conductive fillers. For example, a mixture containing conductive fillers and polymer particles can be formed to have the desirable solid percentage as described above.

In one embodiment, the film or layer formation of the dispersion containing the conductive fillers and the polymer particles can be coated to, e.g., a conductive substrate, an intermediate layer, an adhesive layer, and/or an outer base layer of a BCR. The coated dispersion can further be processed by, e.g., at least partially melting a portion of the polymer particles, followed by, e.g., a cooling process. This partial melting of the polymer particles can form a polymer matrix 280 as depicted in FIG. 2B.

In another embodiment, the film or layer formation of the dispersion containing the conductive fillers and the polymer particles can be processed by admixing a second polymer therewith, e.g., using the ball milling process in a suitable solvent depending on the polymers used. The second polymer can be the same or different from the polymer particles. The dispersion containing conductive fillers, polymer particles, and the second polymer can have the desirable solid weight percentage as described above, e.g., ranging from about 5% to about 60%, or from about 10% to about 50%, or from about 20% to about 40%. The dispersion can then be coated to, for example, a conductive substrate, an intermediate layer, an adhesive layer, and/or an outer base layer of a BCR, using various coating techniques. The applied or coated dispersion can then be solidified, e.g., cured or dried, according to the polymers used. The outer surface coating 129B can then be formed to have both conductive fillers 205 and the polymer particles 280B dispersed in the polymer matrix 280.

In other cases, the dispersion containing conductive fillers and polymers having certain amount solids can also be applied on a separate substrate surface to form a solidified layer, which is then removed from the substrate after the layer formation and then applied as an outer surface coating 129, 129 A/B to a corresponding layer (e.g., the conductive substrate, the outer base layer, etc.) of a bias charging member.

In embodiments, particular surface, electrical, mechanical, and/or structural properties of the resulting bias charging members can be chosen and controlled depending on selection of the layer stack including the outer surface coating 129 or 129 A/B provided over/on the outer base layer 123, with each layer having desirable amount/material selection for fillers and polymers, desirable conditions/methods for layer/coating formation, etc. A combined effect from the outer surface coating and the outer base layer for achieving desired properties and performance objectives can then be obtained for the disclosed bias charging members and related bias charging devices, which is virtually unaffected by numerous environmental and mechanical changes.

For example, the outer surface coating over/on an outer base layer can have a surface roughness ($R_z$) to provide stable, uniform charging over the course of several thousand cycles and prevent build-up of particles at the outer surface of the bias charging members. These coatings can thus prevent the development of abrasions and deformations at the surface of bias charging members to eliminate print defects associated with wear and particulate accumulation at the surface.

The outer base layer 123 can have a thickness ranging from about 10 mm to about 20 cm, or from about 50 mm to about 3 cm, or from about 1 cm to about 2 cm. The outer base layer 123 can have a surface resistivity ranging from about $10^5$ ohm/square to about $10^{13}$ ohm/square, or from about $10^6$ ohm/square to about $10^{11}$ ohm/square, or from about $10^7$ ohm/square to about $10^{10}$ ohm/square. The outer base layer 123 can also have a surface roughness $R_z$ ranging from about 0.1 μm to about 4 μm, or from about 0.2 μm to about 3 μm, or from about 0.3 μm to about 2 μm. The outer base layer 123 can include semiconductive or conductive particles (see 205 of FIGS. 2A-2B) in an amount ranging from about 1% to about 30% by weight, or from about 10% to about 25% by weight, or from about 15% to about 20% by weight, relative to the total weight of the outer surface coating.

The outer surface coating 129, 129 A/B can have a thickness ranging from about 1 μm to about 100 μm, or from about 3 μm to about 40 μm, or from about 4 μm to about 20 μm. The outer surface coating can provide the bias charging member with a surface resistivity ranging from about $10^5$ ohm/square to about $10^{10}$ ohm/square, or from about $10^6$ ohm/square to about $10^9$ ohm/square, or from about $10^7$ ohm/square to about $10^8$ ohm/square. In embodiments, the outer surface coating can provide the bias charging member with a surface roughness $R_z$ of less than about 2 μm, for example, from about 0.1 μm to about 1.99 μm, or from about 0.25 μm to about 1.5 μm, or from about 0.5 μm to about 1.0 μm. The outer surface coating 129, 129 A/B can include conductive particles in an amount ranging from about 1% to about 60% by weight, or from about 10% to about 50% by weight, or from about 15% to about 40% by weight, relative to the total weight of the outer surface coating.

In embodiments, the dimensions, fillers, and/or the electrical, mechanical, and/or other features of the outer surface coating and/or the outer base layer are not limited.

As used herein, the term surface roughness $R_z$ refers to a ten-point mean surface roughness as disclosed in the standard JIS B 0601-1982. The terms, surface roughness, profile, reference length of profile, roughness curve, cut-off value, mean line of profile, and profile peak and valley are as defined in the standard. For example, the ten-point mean roughness shall be the value of difference, being expressed in micrometer (μm), between the mean value of altitudes of peaks from the highest to the $5^{th}$ in height, measured in the direction of vertical magnification from a straight line that is parallel to the mean line and that does not intersect the profile, and the mean value of altitudes of valleys from the deepest to the $5^{th}$ in depth, within a sampled portion, of which length corresponds to the reference length, from the profile. The profile may be depicted by means of a standard profilometer, for example.

Additionally, the disclosed outer surface coating and/or the layer stack can function as a protective layer of the bias charging member to overcome issues due to direct contact with related printer members. For example, uniform charging and desirable chargeability can be achieved over conventional BCRs without the disclosed outer surface coating and/or layer stack. Print quality can be improved. Furthermore, the disclosed outer surface coating and/or layer stack can allow for refurbishing of conventional BCRs or the disclosed exemplary members 120 A-B. In general, when the outer surface of a BCR becomes too damaged to provide acceptable prints, it should be returned for refurbishing. In embodiments, refurbishing can involve applying the disclosed outer surface coating and/or layer stack. By applying this protective layer to a BCR having a damaged surface, either already with or without the protective layer, a BCR can be used multiple times.

EXAMPLES

An exemplary dispersion was prepared by ball milling a mixture containing one or more polymers with carbon black. Table 1 shows various exemplary polymers combined with Vulcan XC72 carbon black (Cabot Corp., Boston, Mass.). Each of the dispersions in Table 1 used ⅛" stainless steel shot and ball milled over the course of about 3 days. The dispersions were then filtered to remove the milling balls and coated on a Imari BCR using a Tsukiage coater to give a coating thickness of about 6 μm. The coated rollers were then dried in a convection oven set at about 140° C. for about 15 minutes to form BCRs. The surface resistivity, e.g., measured by a Hiresta UP Resistivity Meter, and surface roughness, e.g., measured by a Perthometer, of each of these coatings are shown in Table 1.

TABLE 1

| Outer Surface Coating | Carbon Black XC 72 (Wt %) | Surface Resistivity (ohm/sq.) | Surface Rz (μm) |
|---|---|---|---|
| B98/CYMEL ®325 1:1 | 20 | $1.94 \times 10^5$ | 1.478 ± 0.089 |

TABLE 1-continued

| Outer Surface Coating | Carbon Black XC 72 (Wt %) | Surface Resistivity (ohm/sq.) | Surface Rz (μm) |
|---|---|---|---|
| DORESCO ® TA-228/ CYMEL ®1170 65:35 | 4 | $3.11 \times 10^5$ | 1.916 ± 0.199 |
| Blendex 200 | 14 | $1.15 \times 10^5$ | 0.952 ± 0.140 |

In Table 1, exemplary outer surface coatings included: (A) melamine resin composition having a curing agent B98 with CYMEL®325 surface coating; (B) a surface coating including DORESCO® TA-22 8/CYMEL®1170; and (C) an ABS surface coating of Blendex 200. The charge uniformity scanning for each of the resulting BCRs having the surface coatings (A)-(C) was performed before and after 50 kcycle wear testing on the Hodaka fixture. The charge uniformity of each of the resulting BCRs was observed greater than a control BCR with no outer surface coating, indicating that there was no electrical charge build-up or deterioration of charge capacity.

Figure 3:
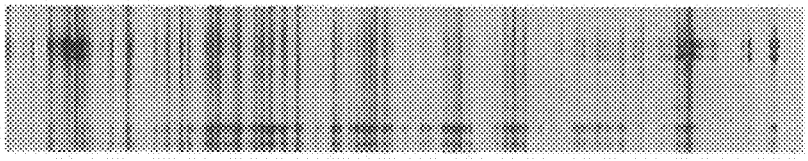
FIG. 3 depicts a scanned printed image from a bias charging member without the disclosed embodiments of the present teachings.

Scanned print images that were collected after subjecting each of the resulting BCRs to 50 kcycle wear on a Hodaka fixture showed no print defects, indicating that no abrasions, scratches or other surface defects were developed during the course of testing and no toner deposits collected on the surface of the resulting BCRs. In contrast, the print image obtained from a control BCR with no outer surface coating or no layer stack showed significant streaking as seen in FIG. 3. The life time of the formed BCRs was then extended due to application of the disclosed outer surface coating or the disclosed layer stack.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one, of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising". Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A bias charging member comprising:

a conductive substrate;

an outer base layer disposed over the conductive substrate, wherein the outer base layer has a surface roughness $R_z$ ranging from about 0.3 μm to about 2 μm and is formed of a material selected from the group consisting of isoprenes, chloroprenes, epichlorohydrins, butyl elastomers, polyurethanes, silicone elastomers, fluorine elastomers, styrene-butadiene elastomers, butadiene elastomers, nitrile elastomers, ethylene propylene elastomers, epichlorohydrin-ethylene oxide copolymers, epichlorohydrin-ethylene oxide-allyl glycidyl ether copolymers, ethylene-propylene-diene (EPDM) elastomers, acrylonitrile-butadiene rubbers (NBR), natural rubber, and combinations thereof;

an outer surface coating disposed on the outer base layer, the outer surface coating comprising one or more polymers and a plurality of conductive fillers to provide the outer surface coating with a surface roughness $R_z$ of less than about 2 μm, wherein the one or more polymers are selected from the group consisting of polycaprolactone, polyurethane, polyurea, polyolefin, polyester, polyimide, polyamide, polycarbonate, phenolic resin, aminoplast resin, copolymer derived from conjugated diene monomers, vinyl aromatic monomer, ethylenically unsaturated nitrile monomer, fluoropolymer and combinations thereof, and an adhesive layer disposed between the conductive substrate and the outer base layer, the adhesive layer comprising conductive fillers.

2. The member of claim 1, wherein the plurality of conductive fillers are present in an amount ranging from about 1 weight percent to about 60 weight percent, relative to a total solids content of the outer surface coating.

3. The member of claim 1, wherein the plurality of polymer particles have an average particle size ranging from about 20 nm to about 10 μm.

4. The member of claim 3, wherein the outer surface coating further comprises a polymer matrix formed by a portion of the one or more polymers or a second polymer same or different from the one or more polymers, wherein the plurality of polymer particles are present in an amount ranging from about 50% to about 99% by weight of the total outer surface coating.

5. The member of claim 1, wherein the outer surface coating has a thickness ranging from about 1 μm to about 100 μm.

6. The member of claim 1, wherein the outer base layer has a thickness ranging from about 10 mm to about 20 cm.

7. The member of claim 1, wherein the outer surface coating has a surface resistivity ranging from about $10^5$ ohm/square to about $10^{10}$ ohm/square.

8. The member of claim 1, wherein the outer base layer has a surface resistivity ranging from about $10^5$ ohm/square to about $10^{13}$ ohm/square.

9. The member of claim 1, wherein a portion of the one or more polymers forms a plurality of polymer particles having an average particle size ranging from about 20 nm to about 10 μm.

10. A bias charging member comprising:

a conductive substrate;

an outer base layer provided over the conductive substrate;

an outer surface coating disposed on the outer base layer, the outer surface coating comprising a plurality of conductive fillers and one or more polymers, and an adhesive layer disposed between the conductive substrate and the outer base layer, the adhesive layer comprising conductive fillers, wherein the outer base layer has a surface resistivity ranging from about $10^5$ ohm/square to about $10^{13}$ ohm/square and a surface roughness $R_z$ ranging from about 0.3 μm to about 2 μm and is formed of a material selected from the group consisting of isoprenes, chloroprenes, epichlorohydrins, butyl elastomers, polyurethanes, silicone elastomers, fluorine elastomers, styrene-butadiene elastomers, butadiene elastomers, nitrile elastomers, ethylene propylene elastomers, epichlorohydrin-ethylene oxide copolymers, epichlorohydrin-ethylene oxide-allyl glycidyl ether copolymers, ethylene-propylene-diene (EPDM) elastomers, acrylonitrile-butadiene rubbers (NBR), natural rubber, and combinations thereof; and wherein the one or more polymers of the outer surface layer are selected from melamine resins, phenolic resins, copolymers derived from conjugated diene monomers, vinyl aromatic monomers, and ethylenically unsaturated nitrile monomers, and combinations thereof, and wherein the outer surface coating has a surface resistivity ranging from about $10^5$ ohm/square to about $10^{10}$ ohm/square and a surface roughness $R_z$ ranging from about 0.1 μm to about 1.99 μm.

11. The member of claim 10, wherein the outer surface coating further comprises a polymer matrix formed by a first portion of the one or more polymers or a second polymer same or different from the one or more polymers, wherein a second portion of the one or more polymers forms a plurality of polymer particles that are present in an amount ranging from about 50% to about 99% by weight of the total outer surface coating.

* * * * *